US006786127B2

(12) United States Patent
Beuth et al.

(10) Patent No.: US 6,786,127 B2
(45) Date of Patent: Sep. 7, 2004

(54) FLUID-ACTUATED LINEAR DRIVE

(75) Inventors: Bernd Beuth, Göppingen (DE); Andreas Muth, Kirchheim (DE); Stefan-Johannes Demuth, Benningen (DE)

(73) Assignee: Festo AG & Co., Esslingen (DE)

( * ) Notice: Subject to any disclaimer, the term of this patent is extended or adjusted under 35 U.S.C. 154(b) by 69 days.

(21) Appl. No.: 10/221,539

(22) PCT Filed: Mar. 9, 2001

(86) PCT No.: PCT/EP01/02660

§ 371 (c)(1),
(2), (4) Date: Sep. 10, 2002

(87) PCT Pub. No.: WO01/69090

PCT Pub. Date: Sep. 20, 2001

(65) Prior Publication Data

US 2003/0029309 A1 Feb. 13, 2003

(30) Foreign Application Priority Data

Mar. 17, 2000 (DE) ..... 200 04 976 U

(51) Int. Cl.[7] ..... F15B 15/20
(52) U.S. Cl. ..... 91/1; 91/361; 91/363 R
(58) Field of Search ..... 91/1, 361, 363 R

(56) References Cited

U.S. PATENT DOCUMENTS 3,158,068 A 11/1964 Bokelman
4,150,686 A * 4/1979 El Sherif et al. ..... 91/363 A
4,481,451 A * 11/1984 Kautz et al. ..... 91/363 R
4,987,822 A * 1/1991 Stoll ..... 91/358 R
5,522,221 A * 6/1996 Kadlicko et al. ..... 92/134

FOREIGN PATENT DOCUMENTS

| | | |
|---|---|---|
| DE | 3325 399 A1 | 2/1985 |
| DE | 295 18 539 U1 | 2/1996 |
| DE | 199 30 020 A1 | 2/2000 |
| EP | 0 355 179 A1 | 2/1990 |
| EP | 0 621 408 A1 | 10/1994 |
| EP | 0 713 980 A2 | 5/1996 |

* cited by examiner

*Primary Examiner*—Edward K. Look
*Assistant Examiner*—Igor Kershteyn
(74) *Attorney, Agent, or Firm*—Hoffmann & Baron, LLP

(57) ABSTRACT

A fluid power operate linear drive possessing a slab housing (2) with an elongated cross sectional outline, in which a plurality of receiving spaces (8) are arranged extending in a common housing plane adjacent to each other in the direction of the longitudinal axis (3) of the cross section. At one first narrow side (21) of the housing there is a piston receiving space (12) extending in the longitudinal direction containing a piston (13) connected with an outwardly running force output part (16). At the opposite second narrow housing side (22) there is an electronic circuitry receiving space (23) containing electronic valve control circuitry (24). Between the piston receiving space (12) and the electronic circuitry receiving space (23) there is at least one valve receiving space (26), which contains a control valve means (25), which is able to be electronically operated and serves for the control of fluid actuation of the piston (13).

20 Claims, 3 Drawing Sheets

FLUID-ACTUATED LINEAR DRIVE

FIELD OF THE INVENTION

The invention relates to a fluid power linear drive whose housing contains a piston able to be displaced by fluid actuation and furthermore an electrically activated control valve means for the control of the fluid actuation.

BACKGROUND OF THE INVENTION

A linear drive disclosed in the European patent publication 0 713 980 A2 of this type comprises a central piston receiving space extending in the longitudinal direction and in which a piston is arranged which is connected with a piston rod. For the operation of the piston pressure medium may be admitted in a controlled fashion, for which purpose a control valve means is present, which includes several control valves inserted like cartridges into the covering lid of the housing of the linear drive. The activation of the control valves takes place by the intermediary of electronic valve control circuitry, which is also secured in the housing.

SUMMARY OF THE INVENTION

This known linear drive does admittedly possess a high degree of integration of the functionally relevant components, but however is less suitable as a basis for the design of miniaturized structures. Accordingly one object of the present invention is to provide a linear drive, on the basis of which more compact sizes are possible while maintaining an integrated design.

This object is to be attained by a fluid power linear drive comprising a slab-like housing with an elongated cross sectional outline, in which slab housing a plurality of receiving spaces are located placed in a common housing plane adjacent to each other in the direction of the cross section's longitudinal axis, a piston receiving space being provided at a first one of the two narrow sides of the housing, such piston receiving space extending in the longitudinal direction and containing a piston connected with an outwardly extending force output part while at the opposite second narrow housing side an electronic circuitry receiving space is provided, which contains electronic valve control circuitry, and between the piston receiving space and the electronic circuitry receiving space at least one valve receiving space for electrically operated control valve means is located, such control valve means serving for the control of the fluid actuation of the piston.

The linear drive accordingly possesses a housing, which may be designed to be extremely flat and is therefore termed a slab housing, wherein receiving spaces for the functionally relevant components are arranged longitudinally adjacent to each other in such a manner that they lie in a common plane coinciding with the cross sectional longitudinal axis of the slab housing, and the available volume of the slab housing is optimally employed. The piston receiving space is associated with one of the narrow sides of the housing with the result that on three sides there is a relatively small wall thickness, which if necessary renders possible reliable sensor detection of the piston position. The opposite narrow side of the housing is associated with a receiving space for electronic circuitry, such space containing the electronic valve control circuitry, which can generate the switching signals necessary for the actuation of the control valve means. The control valve means is seated, as considered in the direction of the longitudinal axis of the cross section of the slab housing, between the piston receiving space and the electronic circuitry receiving space so that on the one hand there are shorter signal paths to the electronic valve control circuitry and on the other hand there are shorter fluid paths to the piston receiving space. The linear drive together with its various components may be extremely simply installed, the overall structure being sturdy in conjunction with an extremely compact form, such overall structure being suitable for miniaturized applications.

Further advantageous developments of the invention are defined in the dependent claims.

The electronic valve control circuitry is preferably provided on a pcb-like (i. e. like a printed circuit board) electronic circuitry support, which is more particularly so inserted in the electronic circuitry receiving space that its board plane is at a right angle to the longitudinal axis of the cross section of the slab housing with the result that compact dimensions are adhered to in the longitudinal direction of the cross section.

In order to be able to link the electronic valve control circuitry with the control valve means in an optimum manner electrically, it is preferred to provide a uniform control receiving space divided up into sections, which on the one hand represent the valve receiving space and on the other hand the electronic circuitry receiving space.

On the longitudinal side, which is opposite to the valve receiving space, of the piston receiving space a sensor means receiving space may be provided, which contains a position detecting means for the detection of the piston position. This means preferably comprises one or more sensors able to be set in a variable manner in the longitudinal direction of the sensor means receiving space, such sensors being electrically connected with the electronic valve control circuitry. It is more especially advantageous for the position detecting means to possess a printed circuit board extending in the longitudinal direction of the sensor means receiving space, such board serving for the transmission of position signals from and/or to the sensors, which may be arranged on the printed circuit board in a manner allowing longitudinal adjustment.

Instead of a control valve means having a 5/2 switching function, which would also be possible, a design is to be particularly recommended with two separate control valve units, which respectively possess a 3/2 switching function and which are respectively responsible for the supply of fluid to the piston for driving same in one of the two possible directions of motion thereof. These two control valve units are preferably accommodated in the longitudinal direction of the slab housing one after the other in a common valve receiving space, it being possible to have a provision such that at least the valve drive signals for one control valve unit are also transmitted by way of the position detecting means so that same may assume a double function as regards transmission of electrical signals.

The slab housing of the linear drive preferably comprises a principal housing body, wherein the different receiving spaces are formed extending from axial one end to the other, a design in the form of an extrusion being more especially possible. The termination of the principal housing body may be in the form of lid-like coverings, which may simultaneously also perform the holding function as regards the component valve means. Between a respective covering and the principal housing body it is possible to fit a printed circuit board, which may be employed for signal transmission between the position detecting means and the electronic valve control circuitry and/or the control valve units.

The printed circuit board may be provided with sealing means, which serve to ensure a fluid-tight connection between the covering and the principal housing body and which in case of need may at least partially perform the function of light guide means in order to render the light signals visible from the outside. The light signal may for example indicate the state of activation of the control valve means and/or the piston position.

The linear drive is more particularly suitable for being fitted with a control valve means, whose valves are at least partly constituted by microvalves produced by micromaching, the use of piezoelectric valves also being possible.

It is furthermore an advantage if both the fluid and also the electrical terminals or connections of the linear drive are collected together on a common terminal side of the slab housing, such side preferably being the rear side which is opposite to the front side with the piston rod extending through it.

BRIEF DESCRIPTION OF THE DRAWINGS

In the following an account will be provided of the invention with reference to the accompanying drawings.

DETAILED DESCRIPTION OF THE PREFERRED EMBODIMENTS

Figure 2:
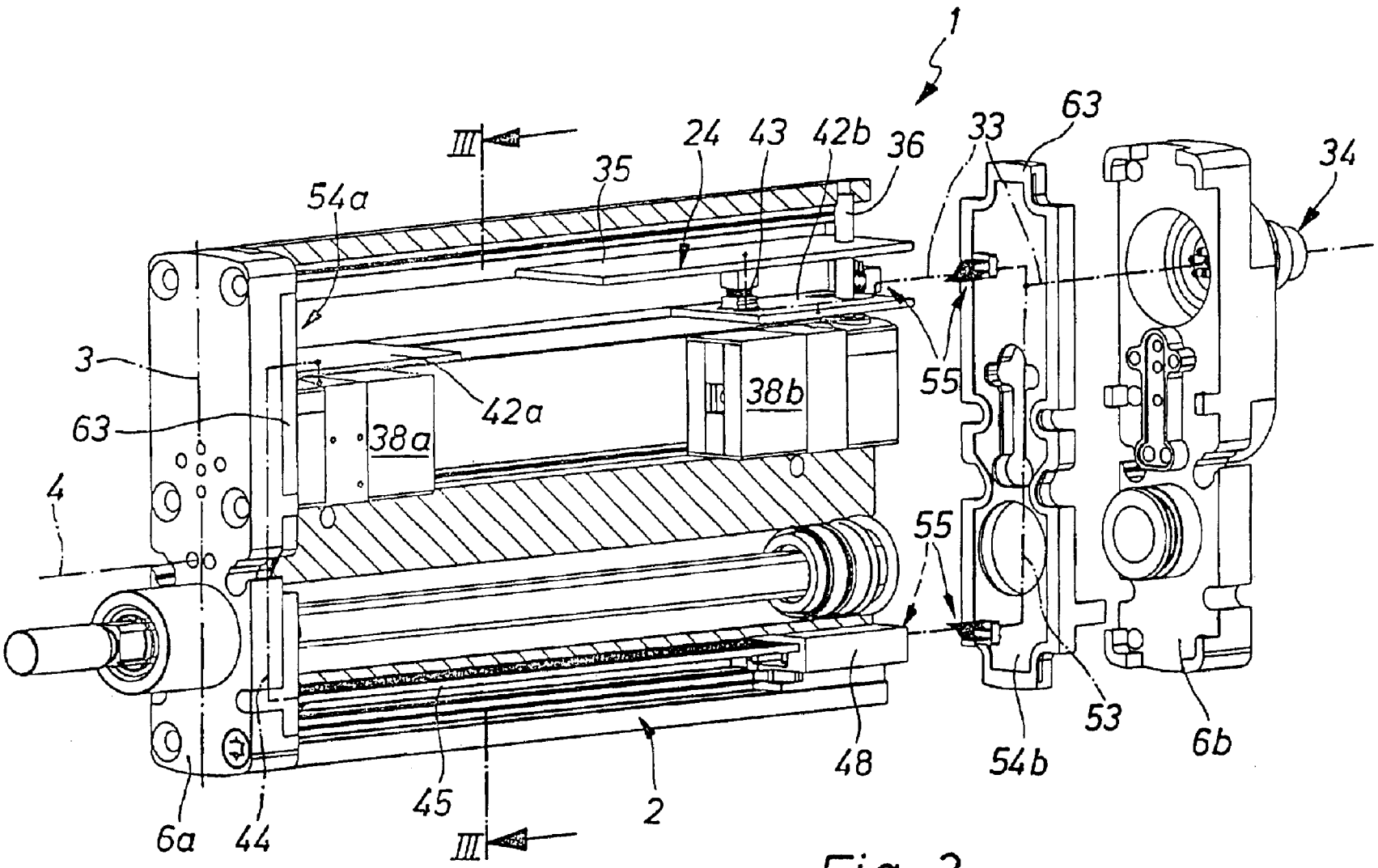
FIG. 2 shows the linear drive of FIG. 1 in a somewhat different perspective view, the covering at the rear being removed.

The linear drive 1 possesses an elongated housing, which owing to its flatiron shape is termed a slab housing 2. As more particularly appears from FIGS. 2 and 3, such slab housing 2 possesses an elongated cross section with a preferably rectangular outline, the longitudinal axis of the cross section being referenced 3. The latter extends at a right angle to the longitudinal axis of the slab housing 2, such longitudinal axis being referenced 4.

The slab housing 2 contains a principal housing body 5 defining the major part of the overall length and furthermore front and rear lid-like coverings 6*a* and 6*b*, mounted on the two axially aligned terminal sides thereof. All these parts have the above mentioned elongated oblong cross sectional shape.

In the interior of the slab housing 2 in the case of the present example in all four respectively receiving spaces 8 are provided, which each extend in parallelism to the longitudinal axis 3 of the housing, such receiving spaces being placed adjacent to each other and aligned in the direction of the cross sectional longitudinal axis 3 and the housing's longitudinal axis 4, same furthermore extending in a common plane of the housing. The latter axis 4 is furthermore the section plane of the representations in FIGS. 1 and 2, in which the principal housing body 5 is shown in a longitudinal section.

The receiving spaces 8 extend parallel to one another and through the principal housing body 5, in each case for the entire length thereof. It is therefore possible to design the principal housing body 5 as an aluminum extrude. The coverings 6*a* and 6*b* terminally mounted terminate the respectively associated openings of the receiving spaces 8.

Such receiving spaces 8 include a piston receiving space 12, which contains a piston 13 adapted to be moved in the longitudinal direction thereof, such piston axially dividing up the piston receiving space 12 in a sealing manner into a front and a rear working space 14*a* and 14*b*. The piston 13 is firmly coaxially connected with a piston rod 16, which extends to the outside in a sealing fashion allowing longitudinal sliding motion through the front covering 6*a* and constitutes a power or force output part, at which a force or a movement is available for applications outside the system. The outer end portion of the piston rod 16 can be connected with any desired moving means.

Into each working space 14*a* and 14*b* piece there opens a first associated fluid duct 17*a* and 17*b*, through which a fluid pressure medium, and more especially compressed air, may be supplied or let off in order to drive the piston 13 and the piston rod 16 in a forwardly or rearwardly directed linear movement in parallelism to the longitudinal axis 4 of the housing.

The piston receiving space 12 is located on a narrow side 21 of the housing. The oppositely aligned second narrow side 22 of the housing is associated with a receiving space 8 designed in the form of an electronic circuitry receiving space 23 containing electronic valve control circuitry 24. By way of the latter electrical control of a control valve means 25 takes place, which is accommodated in a receiving space 8 placed between the piston receiving space 12 and the electronic circuitry receiving space 23, such receiving space 8 being herein termed the valve receiving space 26.

The fourth receiving space 8, remaining to be described, is termed a sensor means receiving space 27 and is located on the longitudinal side, opposite to the valve receiving space 26, of the piston receiving space 12 between the latter and the adjacent outer face section 31, on the narrow side, of the principal housing body 5. The sensor means receiving space 27 contains a position detecting means 32, which in the embodiment of the invention is so designed that certain predetermined axial positions of the piston 13 may be detected by it. It would also be possible to have it designed as a displacement measuring system, using which the current piston position could be found.

The electronic valve control circuitry 24 merely occupies part of the length of the electronic circuitry receiving space 23, it being accommodated in the rear end section thereof. It is connected by way of first electrical conductors 33, as indicated in chained lines, with connection or terminal means 34, which are accessible from the outside, mounted on the rear covering 6*b*, such connection means 34 being preferably designed in the form of plug means and rendering possible an electrical connection with an external control means, not illustrated.

Preferably the electronic valve control circuitry 24 is provided on a board-like electronic circuitry support 35, as for example as a printed circuit board, which is secured from the rear side in the electronic circuitry receiving space 23 where it is fixed by suitable securing means 36. The alignment is more particularly such that the plane of the electronic circuitry support 35 is at a right angle to the longitudinal axis 3 of the cross section or in other words the width direction of the electronic circuitry support 35 runs parallel to the transverse axis 37 of the cross section, of the slab housing 2. It is in this manner that the dimensions of the slab housing 2 along the longitudinal axis 3 coinciding with the thickness direction of the electronic circuitry support 35 are kept extremely small.

During operation the control valve means 35 receives the necessary electrical actuating signals by the intermediary of the electronic valve control circuitry 24 and in a manner matching the external control means in order to cause the fluid actuation of the piston 13 in the desired fashion. In this respect there may be a provision such that the electronic valve control circuitry 24 generates the switching signals for the control valve means 25 on the basis of a received switching signal or bus signal. In this respect the microprocessor necessary for the bus protocol may be employed, using suitable logic gates, for presetting the switching states of the control valve means. If in the control valve means 25 types of valves are utilized requiring a voltage differing from the normally supplied voltage—for example in the case of so-called microvalves or piezoelectric valve—it is possible for the electronic valve control circuitry 24 also to comprise the respective means for voltage conversion.

It will be clear that the electronic valve control circuitry 24 may possess its own, preferably adjustably programmable, control program, something which however is not absolutely necessary. The control signal may be supplied simply by the external control means, the electronic valve control circuitry 24 possessing suitable communication means in order to be able to distribute the incoming and possibly also outgoing control signals in accordance with correct association.

In the embodiment the control valve means 25 is divided up into two control valve units 38*a* and 38*b*, which each respectively have the functionality of a 3/2 switching valve. In this case it may be simply a question of 3/2 switching valves as such or however for example of two linked 2/2 valves, if necessary with the addition of an amplifier, something which is more particularly an advantage, if the control valve units 38*a* and 38*b* are composed of so-called microvalves. Microvalves are as a rule produced using suitable micromachining methods and render possible extremely small overall sizes, something which moreover applies for piezoelectric valve as well.

The two control valve units 38*a* and 38*b* are accommodated in the valve receiving space 26 in sequence one after the other in the longitudinal direction 4 of the slab housing 2. Owing to their short overall length they are separated axially by an intermediate space from one another. It is convenient for the control valve units 38*a* and 38*b* to be seated in the front and, respectively, rear terminal section of the valve receiving space 26, into which they are inserted from the terminal side. For fixation there may be a provision such that each control valve unit 38*a* and 38*b* is secured on the front and, respectively, rear associated covering 6*a* and 6*b*, it being possible to employ a suitable transverse outline of the valve receiving space 26 to obtain a transverse support in the interior of the slab housing 2.

For simplification of the electrical contact system and also to customize valve circuits in case of need in addition, each control valve unit 38*a* and 38*b* is provided with a printed circuit board 42*a* and 42*b* having electrical wiring and/or electrical or, respectively, electronic components, which flanks the respective control valve unit 38*a* and 38*b* on the longitudinal side associated with the electronic circuitry receiving space 23 and is in electrical contact with the respectively associated control valve unit. These printed circuit boards 42*a* and 42*b*, whose length is approximately preferably the same as that of the associated control valve unit 38*a* and 38*b*, preferably extend in parallelism to the electronic circuitry support 35 and accordingly also extend at a right angle to the longitudinal axis 3 of the cross section. The printed circuit board 42*b* mounted on the rear control valve unit 38*b* is connected by electrical contact means 43 directly with the directly adjacent electronic valve control circuitry 24. The front printed circuit board 42*a* associated with the front control valve unit 38*a* is also linked by way of second electrical conductors 14 with the electronic valve control circuitry 24.

Figure 3:
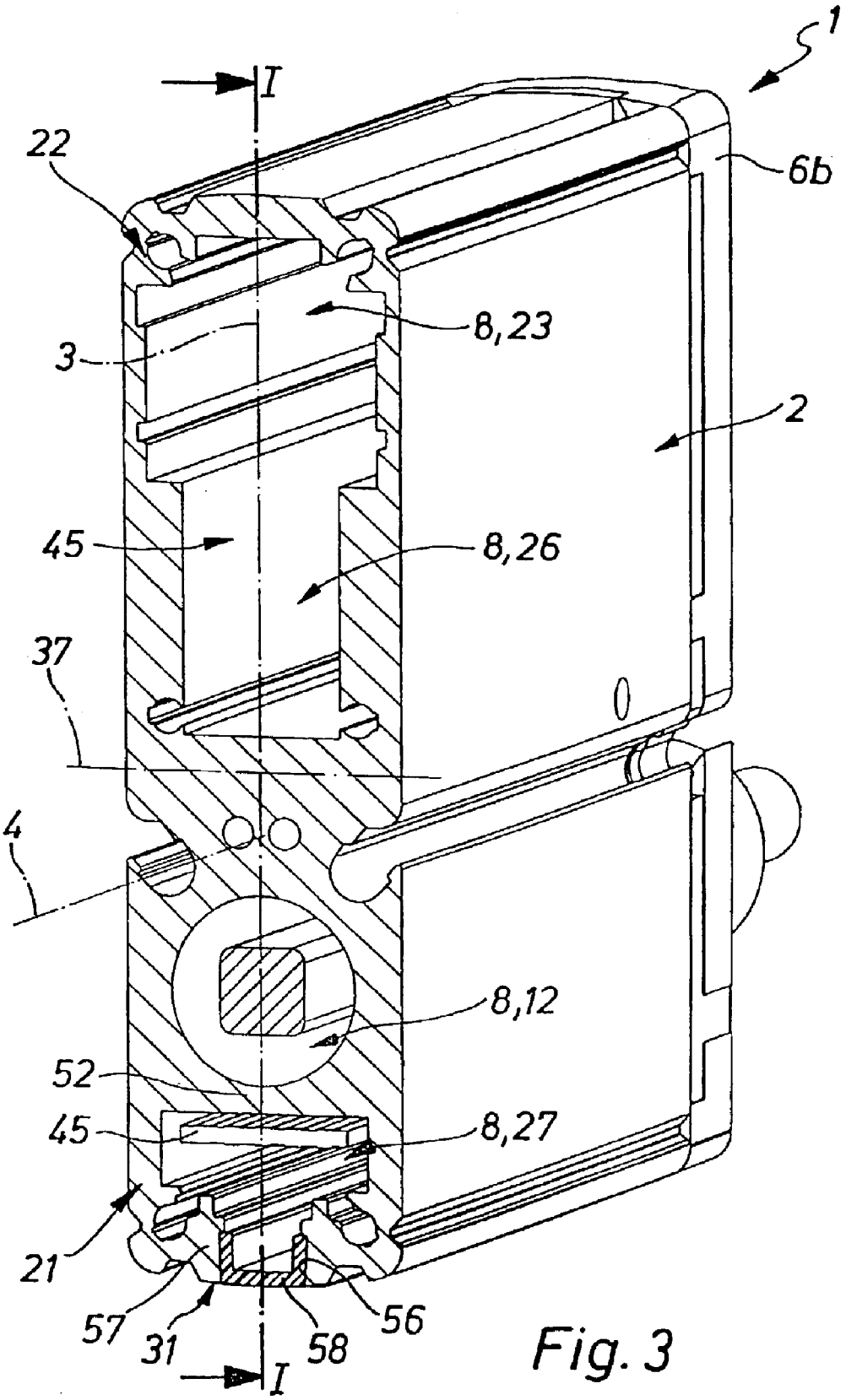
FIG. 3 illustrates the linear drive of FIGS. 1 and 2 in a perspective view in a cross section in accordance with the section line III—III as in FIGS. 1 and 2.

For simplification of the assembly and any necessary electrical linking of the control valve means 25 and the electronic valve control circuitry 24 in the working example the valve receiving space 26 and the electronic circuitry receiving space 23 are designed in the form of space sections of a common receiving space merging into each other, such common receiving space being termed the control receiving space 45, the space being illustrated in FIG. 3 particularly clearly. In other words it is a question of a control receiving space 45 which is somewhat enlarged cross section, which as a single structural unit represents both the valve receiving space 26 and also the electronic circuitry receiving space 23.

Figure 1:
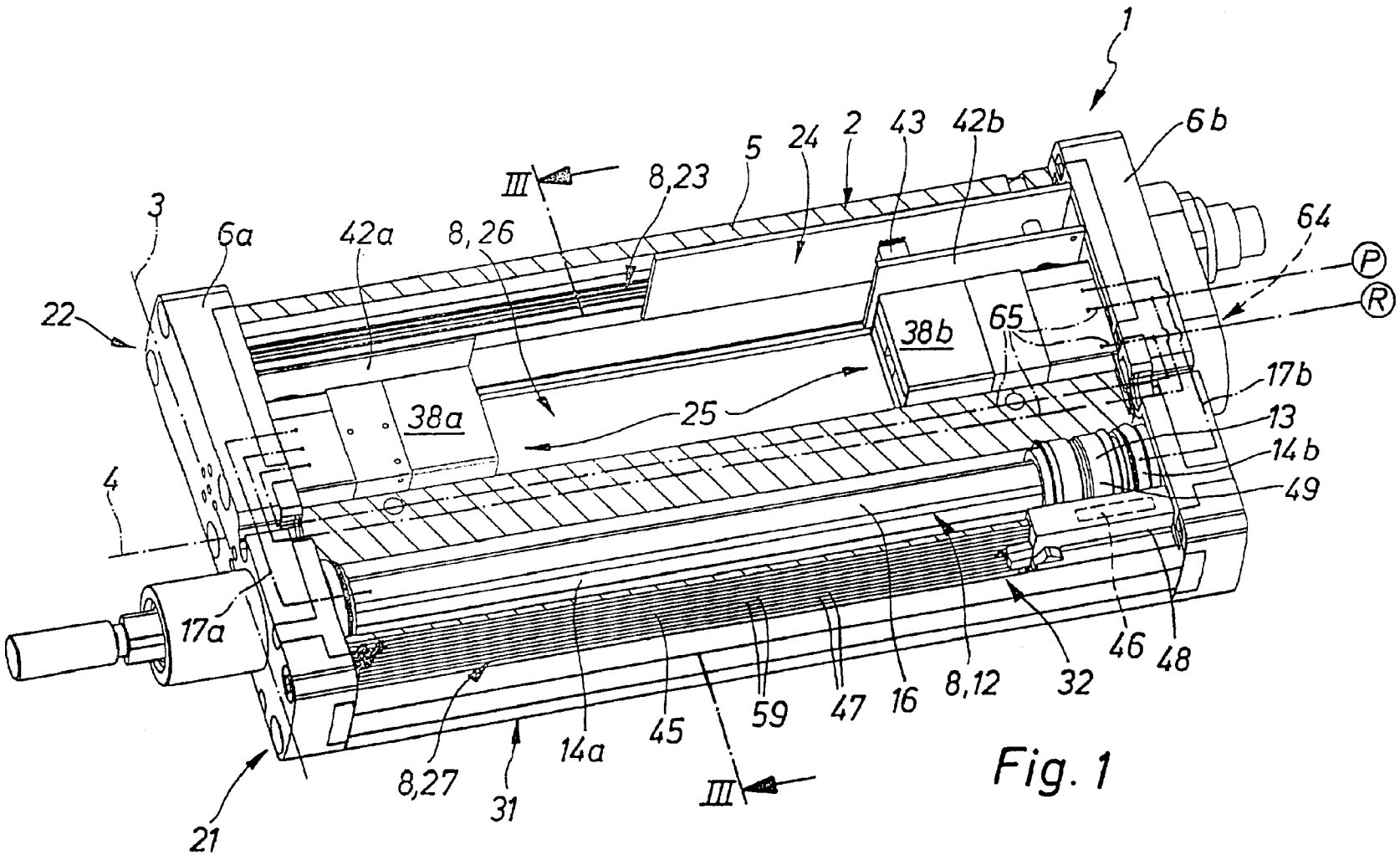
FIG. 1 shows a preferred design of the fluid power linear drive of the invention in an oblique elevation and with the slab housing partly illustrated in longitudinal section, the line of the section being indicated at I—I in FIG. 3.

In the working embodiment illustrated the position detecting means 32 accommodated in the sensor means receiving space 27 possesses a printed circuit board 45 extending for the entire length of the sensor means receiving space, such printed circuit board 45 having at least one sensor 46, represented in figure in chained lines in FIG. 1, in such a manner that it is connected with first signal conductors 47 of the printed circuit board 45.

Here the sensor 46 is preferably held on a carriage body 48, which completely or partially straddles the printed circuit board 45 in such a manner that it is held on the printed circuit board 45 and simultaneously it is guided in the longitudinal direction of the printed circuit board 45 and accordingly parallel to the longitudinal axis 4 of the housing. Guiding of the slab housing 2 is unnecessary for this reason. The electrical contact between the sensor 46 and the first signal conductors 47 is so provided that same is independent of the instantaneous of the carriage body 48 and of the sensor 46 arranged thereon.

An actuating element 49, which is ganged for movement with the piston 13 or with the piston rod 16, and for example in the form of a permanent magnet, is in a position of tripping the sensor 46—for instance in the form of a reed switch—when as part of the movement of the piston it arrives in a position radially opposite to the sensor 46. The magnetic field of the actuating element 49 may then penetrate the thin partition 52 of the slab housing 2 separating the piston receiving space 12 from the sensor means receiving space 27. When the sensor is tripped, the resulting position detection signals are transmitted by way of first signal conductors 47 to the electronic valve control circuitry 24. This takes place by way of intermediately placed third electrical conductors 53, which are provided on a rear printed circuit board 54*b* and are arranged axially between the rear terminal side of the principal housing body 5 and the rear covering 6*b* placed thereon. Pairs of electrical contact means 55, which cooperate with each other and are preferably in the form of plug connectors in this case serve to provide electrical contact of the rear printed circuit board 54*b* with on the one hand the printed circuit board 45 of the position detecting means 32 and on the other hand the electronic valve control circuitry 24 or with the printed circuit board 42*b*, coupled with it electrically, of the rear control valve unit 38*b*.

It will be clear that in lieu of having merely one sensor 46 a plurality of sensors could be provided able to be set in position by the user of the equipment as desired in the longitudinal direction on the printed circuit board 45, such sensors being connected with the electronic valve control circuitry 24 in a comparable manner.

By the intermediary of the carriage body 48 a satisfactory guidance of the parts may be ensured without having to insist on particularly small tolerances.

The longitudinal setting of the sensor 46 or, respectively, the carriage body 48 carrying same, is preferably performed from the outside through a longitudinal slot 56, which runs parallel to the sensor means receiving space 27 and radially extends through that housing wall section 57, which delimits the sensor means receiving space 27 on the longitudinal side opposite to the piston receiving space 12. The longitudinal slot 56 accordingly opens internally into the sensor means receiving space 27 and externally at the first outer side section 31 on the narrow side. Access to the carriage body 48 and, respectively, the sensor 46 is possible through the section 31 for the purpose of axially setting the position.

In order to prevent entry of moisture and/or other foreign matter in the sensor means receiving space 27 the longitudinal slot 56 is normally closed by a slot cover 58. In the working embodiment illustrated this cover is releasably inserted in the longitudinal slot 56 and may be removed temporarily for setting the position of the sensor 46. Preferably the slot cover 58 is constituted by an elastomeric part, which may be adapted to the desired length of the slot without any trouble.

A particular advantage of the linear drive 1 in accordance with the example is that the position detecting means 32 has a multiple function and is also employed to transmit valve control signals from the electronic valve control circuitry 42 to the front control unit 38*a* arranged on the front covering 6*a*. For this purpose second signal conductors 59 provided on the printed circuit board 45 of the position detecting means 32 as components of the above mentioned second electrical conductors 44 are employed in order to produce the electrical connection. Specifically this means in the case of the working example that as well between the front terminal side of the principal housing body 5 and the front covering 6*a*, placed in front of same, a printed circuit board, termed the front printed circuit board 54*a*, is placed in between, which like the rear printed circuit board 54*b* produces an electrical connection between the front control valve unit 28*a* and the printed circuit board 45 of the position detecting means 32. By way of the above mentioned third electrical conductors 53 there is then the further signal path to the electronic valve control circuitry 24.

The front and rear printed circuit boards 54*a* and 54*b* serve simultaneously as seal supports and they are provided with seal means 63, which ensure a hermetic joint between the the principal housing body 5 and the front and rear coverings 6*a* and 6*b* thereon. In this respect the seal means 64 may at least in part be in the form of light guide means serving to ensure that the light signals produced by light producing means on the printed circuit boards 54*a* and 54*b* are transmitted to the peripheral portion of the slab housing 2 and are thus visible for an external observer. This means that any desired display of position, function and condition is possible without any trouble.

Both the front and also the rear printed circuit boards 54*a* and 54*b* may be utilized, if required, for the integration of further electronic components, for example for valve control or for sensor systems.

In order to make the electrical and fluid power connection necessary for operation in a simple manner, in the working embodiment illustrated there is a provision such that on a common terminal face of the slab housing 2, in the present case on the rearwardly facing terminal face of the rear covering 6*b*, in addition to the electrical connection means 34 furthermore fluid power connection means 64 are present for the supply and/or output of fluid energy. The fluid connection means 64 communicate with fluid ducts 65 running in the interior of the slab housing 2, which lead to the two control valve units 38*a* and 38*b* in order to supply compressed air or to vent it. By means of the control valve units 38*a* and 38*b* the further fluid ducts 65 are linked with the above mentioned first fluid ducts 17*a* and 17*b* in a manner dependent on the position of switching in order to cause the desired piston movement.

What is claimed is:

1. A fluid power linear drive comprising a substantially flat slab housing with an elongated cross sectional outline, said slab housing having a plurality of receiving spaces integrally formed therein and placed in a common housing plane adjacent to each other in the direction of a longitudinal axis of said cross sectional outline, said plurality of receiving spaces including a piston receiving space being provided at a first narrow side of the housing, such piston receiving space extending in the longitudinal direction and containing a piston connected with an outwardly extending force output part while at an opposite second narrow housing side an electronic circuitry receiving space is provided which contains electronic valve control circuitry, and between the piston receiving space and the electronic circuitry receiving space at least one valve receiving space for electrically operated control valve means is located, such control valve means serving for the control of the fluid actuation of the piston.

2. The linear drive as set forth in claim 1, wherein the electronic valve control circuitry is provided on a a printed circuit board.

3. The linear drive as set forth in claim 2, wherein the printed circuit board is so arranged that the plane of its board extends at a right angle to the cross sectional longitudinal axis of the slab housing.

4. The linear drive as set forth in claim 1, wherein on the side facing the electronic circuitry receiving space the control valve means contains at least one printed circuit board having electrical components, said at least one printed circuit board being connected electrically with the electronic valve control circuitry.

5. The linear drive as set forth in claim 4, wherein the printed circuit board of the control valve means is so arranged that the plane of its board extends at a right angle to the cross sectional longitudinal axis of the slab housing.

6. The linear drive as set forth in claim 1, wherein the valve receiving space and the electronic circuitry receiving space are formed by merging sections of a control means receiving space.

7. The linear drive as set forth in claim 1, wherein the control valve means possesses two control valve units arranged in sequence in the longitudinal direction of the slab housing.

8. The linear drive as set forth in claim 7, wherein the two control valve units are arranged on opposite axial terminal portions of the slab housing, electrical valve control signals being transmitted from the valve control electronic circuitry by way of a position detecting means to at least one of the valve units.

9. The linear drive as set forth in claim 8, wherein both a transmission of position detection signals and also a conduction of valve control signals take place by way of the printed circuit board of the position detecting means.

10. The linear drive as set forth in claim 1, wherein the receiving spaces are formed in a principal body of the slab housing and extend through the same in the longitudinal direction respectively, a covering being mounted on both terminal sides of the principal housing body.

11. The linear drive as set forth in claim 1, wherein the force output part is a piston rod extending to the outside at one terminal side of the slab housing at least.

12. A fluid power linear drive comprising a slab housing with an elongated cross sectional outline, said slab housing having a plurality of receiving spaces placed in a common housing plane adjacent to each other in the direction of a longitudinal axis of said cross sectional outline, a piston receiving space being provided at a first narrow side of the housing, such piston receiving space extending in the longitudinal direction and containing a piston connected with an outwardly extending force output part, while at an opposite second narrow housing side an electronic circuitry receiving space is provided, which contains electronic valve control circuitry, and between the piston receiving space and the electronic circuitry receiving space, at least one valve receiving space for electrically operated control valve means is located, such control valve means serving for the control of the fluid actuation of the piston and, wherein a sensor means receiving space is provided on the longitudinal side, which is opposite to the valve receiving space, of the piston receiving space in the interior of the slab housing said sensor means receiving space extending along the piston receiving space and containing a position detecting means for the detection of the piston position.

13. The linear drive as set forth in claim 12, wherein the position detecting means contains one or more sensors able to be set in position in the longitudinal direction of the sensor means receiving space, such sensor means preferably being connected electrically with the electronic valve control circuitry.

14. The linear drive as set forth in claim 12, wherein the position detecting means comprises a printed circuit board running in the length direction of the sensor means receiving space said printed circuit board serving for the transmission of signals from the position detecting means.

15. The linear drive as set forth in claim 14, wherein at least one sensor is mounted on the printed circuit board in a manner allowing longitudinal adjustment and independent of its instantaneous position is connected with at least one signal conductor of the printed circuit board.

16. A fluid power linear drive comprising a slab housing with an elongated cross sectional outline, said slab housing having a plurality of receiving spaces placed in a common housing plane adjacent to each other in the direction of a longitudinal axis of said cross sectional outline, a piston receiving space being provided at a first narrow side of the housing, such piston receiving space extending in the longitudinal direction and containing a piston connected with an outwardly extending force output part while at an opposite second narrow housing side an electronic circuitry receiving space is provided, which contains electronic valve control circuitry, and between the piston receiving space and the electronic circuitry receiving space at least one valve receiving space for electrically operated control valve means is located, such control valve means serving for the control of the fluid actuation of the piston and wherein the receiving spaces are formed in a principal body of the slab housing and extend through the same in the longitudinal direction respectively, a covering being mounted on both terminal sides of the principal housing body and wherein between at least one covering and the principal housing body a printed circuit board provided with sealing means is placed intermediately, such printed circuit board serving preferably for the transmission of valve control signals and/or position detection signals.

17. The linear drive as set forth in claim 16, wherein the sealing means are at least partly constituted by light guide means for light signals, which are more especially produced by the intermediary of the electronic valve control circuitry.

18. A fluid power linear drive comprising a slab housing with an elongated cross sectional outline, said slab housing having a plurality of receiving spaces placed in a common housing plane adjacent to each other in the direction of a longitudinal axis of said cross sectional outline, a piston receiving space being provided at a first narrow side of the housing, such piston receiving space extending in the longitudinal direction and containing a piston connected with an outwardly extending force output part while at an opposite second narrow housing side an electronic circuitry receiving space is provided, which contains electronic valve control circuitry, and between the piston receiving space and the electronic circuitry receiving space at least one valve receiving space for electrically operated control valve means is located, such control valve means serving for the control of the fluid actuation of the piston and wherein the control valve means is in the form of microvalves produced by micromachining.

19. A fluid power linear drive comprising a slab housing with an elongated cross sectional outline, said slab housing having a plurality of receiving spaces placed in a common housing plane adjacent to each other in the direction of a longitudinal axis of said cross sectional outline, a piston receiving space being provided at a first narrow side of the housing, such piston receiving space extending in the longitudinal direction and containing a piston connected with an outwardly extending force output part while at an opposite second narrow housing side an electronic circuitry receiving space is provided, which contains electronic valve control circuitry, and between the piston receiving space and the electronic circuitry receiving space, at least one valve receiving space for electrically operated control valve means is located, such control valve means serving for the control of the fluid actuation of the piston and wherein both electrical and also fluid connection means are provided for electrical and fluid energy transmission on a common terminal side of the slab housing.

20. A fluid power linear drive comprising a slab housing with an elongated cross sectional outline, said slab housing having a plurality of receiving spaces placed in a common housing plane adjacent to each other in the direction of a longitudinal axis of said cross sectional outline, a piston receiving space being provided at a first narrow side of the housing, such piston receiving space extending in the longitudinal direction and containing a piston connected with an outwardly extending force output part while at an opposite second narrow housing side an electronic circuitry receiving space is provided, which contains electronic valve control circuitry, and between the piston receiving space and the electronic circuitry receiving space, at least one valve receiving space for electrically operated control valve means is located, such control valve means serving for the control of the fluid actuation of the piston and wherein the control valve means is in the form of piezoelectric valves.

* * * * *